United States Patent [19]

Gallusser et al.

[11] 4,359,255

[45] Nov. 16, 1982

[54] COUPLING RING HAVING DETENT MEANS

[75] Inventors: David O. Gallusser, Oneonta; Ann E. Peterson, Sidney, both of N.Y.

[73] Assignee: The Bendix Corporation, Southfield, Mich.

[21] Appl. No.: 206,773

[22] Filed: Nov. 14, 1980

[51] Int. Cl.[3] ..... H01R 13/625

[52] U.S. Cl. ..... 339/90 R; 339/DIG. 2

[58] Field of Search ..... 285/82, 86; 339/89 R, 339/89 M, 89 C, 90 R, 90 C, DIG. 2

[56] References Cited

U.S. PATENT DOCUMENTS

| | | | |
|---|---|---|---|
| 3,551,880 | 12/1970 | Hartwell | 339/89 |
| 3,805,379 | 4/1974 | Vetter | 29/629 |
| 3,971,614 | 7/1976 | Paoli et al. | 339/89 R |

FOREIGN PATENT DOCUMENTS

| | | | |
|---|---|---|---|
| 857344 | 12/1960 | United Kingdom | 339/186 M |

*Primary Examiner*—John McQuade

*Attorney, Agent, or Firm*—Raymond J. Eifler

[57] ABSTRACT

This invention is an electrical connector assembly that prevents unwanted decoupling when this connector assembly is connected to another connector assembly. The first connector assembly is characterized by at least one resiliently deflectable and rearwardly extending projection 31 that mates with a notch 21 in the coupling ring 20 to prevent rotation of the coupling ring when it is connected to the second connector housing. An outer ring 10 is used to unlock the coupling ring and allow rotation when the coupling ring 10 is pushed forward against the coupling ring 20 and a forward projection 11 on the outer ring 10 enters the notch 21 in the coupling ring 20 and forcing the housing projection 31 out of the notch so that when the outer ring 10 is rotated the coupling ring 20 will also rotate.

1 Claim, 4 Drawing Figures

COUPLING RING HAVING DETENT MEANS

This invention relates to electrical connectors and is more particularly related to electrical connectors molded from plastic.

An electrical connector assembly is generally comprised of two separate housings, each having contacts matable with contacts in the other housing when the housings are connected together by a coupling member. Some connectors are secured together by a bayonet type coupling mechanism. This generally includes pins projecting radially outwardly from the housing of one of the connector assemblies which are adapted to enter grooves and a coupling ring provided on another electrical connector. Each groove has an entrance portion at the forward end of the coupling ring from which it extends inwardly and terminates in a recess. The pins enter the bayonet grooves when the connector moves into a mated position, and moves further into the groove when the coupling ring is rotated. When the coupling ring is fully connected to the other housing, the bayonet pins are at the ends of the bayonet grooves. When this type of connector housing is used on an aircraft they are subjected to extensive vibration, and the pins move from the grooves allowing the coupling ring to rotate. This rotation no matter how slight, begins decoupling of the connector housings so that the contacts mounted within the housings also move towards an unmated position. Accordingly, under severe vibration, the coupling nut can rotate resulting in an unmating of some of the contacts within the connector.

DISCLOSURE OF THE INVENTION

This invention prevents the decoupling of electrical connector housings by providing a locking mechanism that prevents rotation of the coupling nut connecting the housings together.

The invention is an electrical connector assembly characterized by a housing having resiliently deflectable rearwardly extending projections that mate with a notch in the coupling ring flange when the coupling ring is in its forward most position and by an outer ring, which surrounds the coupling ring, and which includes an internal flange that has forwardly extending projections adapted to mate with the notch in the coupling ring to release the rear projections on the housing when the outer ring is pressed forward against the coupling ring.

One advantage of this invention is that it provides an electrical connector with a mechanism that prevents rotation of a coupling ring when the coupling ring is connected to another housing.

DETAILED DESCRIPTION OF THE INVENTION

Figure 1:
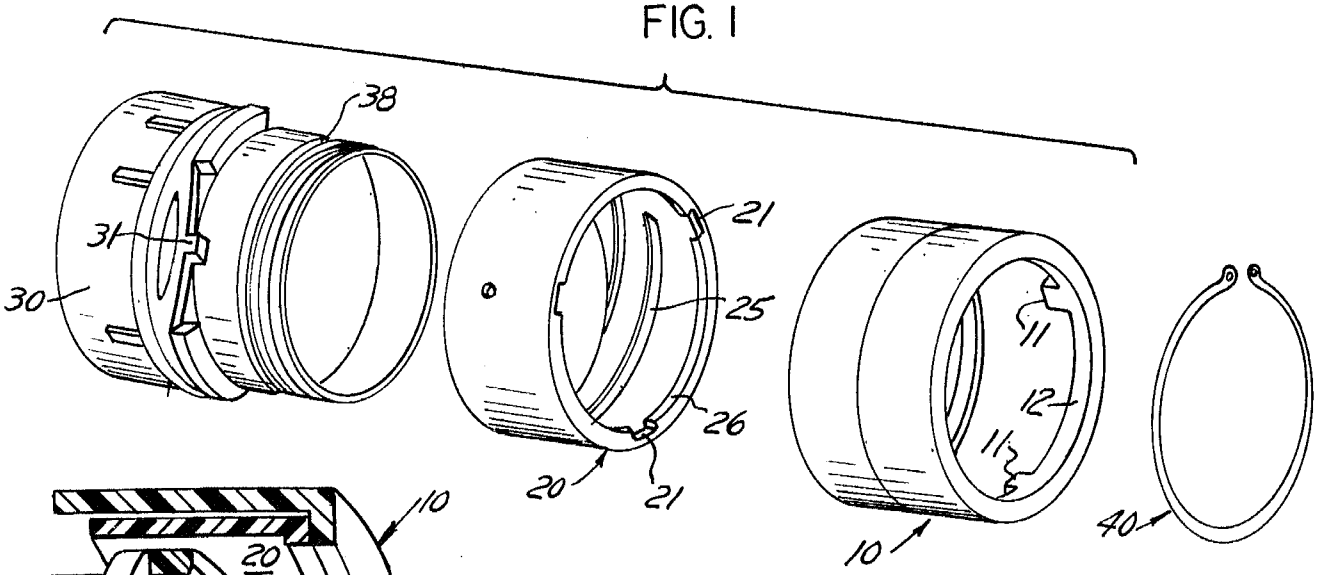
FIG. 1 is an exploded view of an electrical connector assembly incorporating the principles of this invention.

Referring now to the drawings, FIG. 1 illustrates an exploded view of the electrical connector that includes a housing 30, a coupling ring 20, an outer ring 10 and a snap ring 40 which snaps into a groove 38 in the housing 30 to mount the coupling ring 20 and outer ring 10 to the housing 30. The coupling ring 20 includes one or more notches 21 in an inwardly extending flange 26. The notches 21 adapted to receive the rearwardly extending projections 31 on the housing and the forwardly extending projections 11 on an internal shoulder 12 of the outer ring 10. The coupling ring 20 also includes one or more grooves 25 adapted to receive the bayonet pin on another connector housing when the housings are mated.

Figure 2:
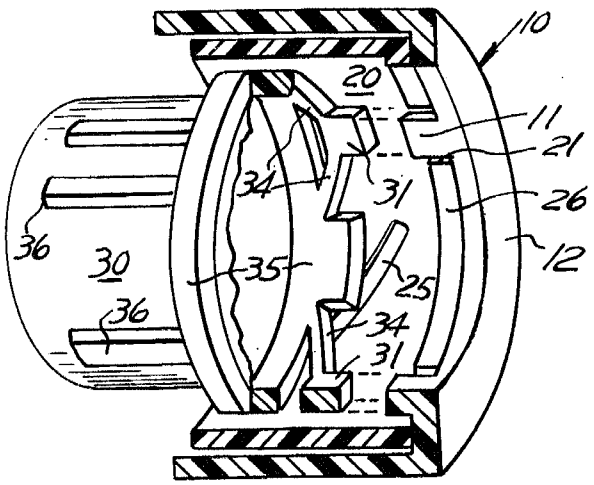
FIG. 2 is a partial cutaway view of an electrical connector assembly incorporating the principles of this invention.

FIG. 2 illustrates how the coupling ring 20 and outer ring 10 are telescopically mounted over the housing 30. The forward portion of the housing 30 includes a plurality of keys 36 for alligning the housing 30 with another housing (not shown). The housing 30 further includes an annular shoulder 35 having integral therewith a pair of rearwardly extending arms 34 that terminate in a rearwardly extending projection 31. The arms 34 allow the projection 31 to be resiliently deflected in the forward direction.

When the forward projection 11 of the outer ring 10 is located in a notch in the coupling ring 20, rotation of the outer ring will rotate the coupling ring 20. Since the outer ring 10 may be moved axially relative to the coupling ring 20, rearward movement of the outer ring 10 will disengage the forward projection 11 from the notch in the coupling ring 20. Upon disengagement, rotation of the outer ring will not rotate the coupling ring.

Figure 3:
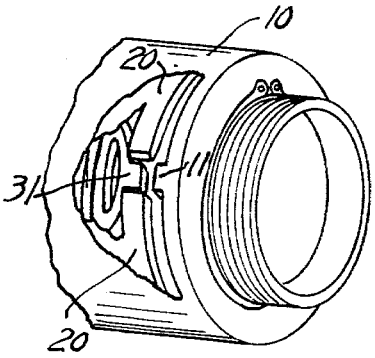
FIG. 3 illustrates an electrical connector assembly with a coupling ring in an locked position.

FIG. 3 illustrates the coupling ring 20 when it is connected to another connector assembly (not shown) and is in its locked position i.e., the projection 31 in the housing 30 is located in the notch 21 in the coupling ring which prevents the coupling ring from rotating.

Figure 4:
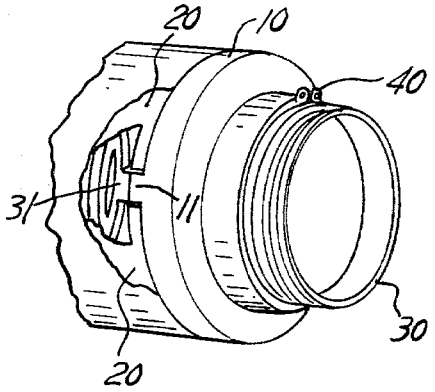
FIG. 4 illustrates an electrical connector with the coupling ring in an unlocked position so that it may be rotated.

FIG. 4 illustrates how the coupling ring 20 may be unlocked i.e., rotated. This is accomplished by moving the outer ring 10 forwardly and rotating it until the forwardly extending projection 11 therein finds the notch 21 in the coupling ring 20 and deflects the housing projection 31 out of the notch 21. Rotation of the outer ring 10 will then rotate the coupling ring 20.

Referring again to drawings 2, 3 and 4, operation of connector assembly is as follows: when it is desired to connect the assembly to another connector assembly (not shown), the outer ring 10 is pushed forwardly and rotated until the forward projection 11 therein mates with the notch 21 and the coupling ring. Rotation of the outer ring 10 will then rotate the coupling ring 20 which will then draw together the two assemblies as the pin in the other assembly tracks through the groove into coupling 20. As the coupling ring 20 moves forwardly, the rearwardly extending projection 31 on the housing eventually alligns with the notch 21 and will enter the notch 21 when the forward force being applied to the outer ring is removed. This prevents the coupling ring 20 from further rotation. To disconnect the connector assemblies, the coupling ring 20 is unlocked and allowed to rotate by moving the outer ring 10 forwardly until the projection 11 enters the notch 21 and pushes out the rearwardly extending projection 31. Rotation then of the outer ring 10 will rotate the coupling ring 20 to disengage the coupling ring 20 from the other connector assembly (not shown).

While a preferred embodiment of the invention has been disclosed, it will be apparent to those skilled in the art, that changes may be made to the invention as set forth in the appended claims and, in some instances, certain features of the invention may be used to advantage without corresponding use of other features. For example, the rearward projections 31 on the housing may be replaced with axially extending and resiliently deflectable fingers that mate with a recess in the rear of the coupling ring having a corresponding configuration 20. Accordingly, it is intended that the illustrative descriptive materials herein be used to illustrate the principles of the invention and not limit the scope thereof.

Having described the invention what is claimed is:

1. A first electrical connector assembly for use in connecting to a second electrical connector assembly, the first connector assembly of the type having: a cylindrical housing having a front portion, a rear portion and an annular shoulder on the outside of the housing between the front and rear portions; a coupling ring telescoped over the housing, said coupling ring having a forward portion adapted to connect to said second housing and a rear portion that includes an annular shoulder extending inwardly; means for mounting said coupling ring to said first housing for rotational and axial movement relative to said first housing; and means for selectively preventing rotation of the coupling ring to prevent unwanted rotation of the coupling ring when the first connector assembly and the second connector assembly are coupled together, the improvement wherein the means of preventing rotation of the coupling ring comprises:

at least one rearwardly extending projection mounted on the rear face of the shoulder on said housing, said rearward projection resiliently deflectable in the forward direction;

at least one notch in said coupling ring shoulder, said notch adapted to receive the rearwardly extending projection on said housing when said coupling ring is in its forward most position; and a ring telescopically mounted over the coupling ring for rotational and axial movement relative to said coupling ring, said ring having a forward portion and a rear portion that includes an inwardly extending shoulder that includes at least one forwardly extending projection adapted to mate with the notch in said coupling ring when said ring is pressed forwardly against said coupling ring.

* * * * *